United States Patent [19]

Harada

[11] 4,198,938

[45] Apr. 22, 1980

[54] VACUUM ACTUATED SYSTEM

[75] Inventor: Masanori Harada, Yokohama, Japan

[73] Assignee: Nissan Motor Company, Limited, Yokohama, Japan

[21] Appl. No.: 742,994

[22] Filed: Nov. 18, 1976

[30] Foreign Application Priority Data

Nov. 19, 1975 [JP] Japan ..... 50-139075

[51] Int. Cl.[2] ..... F02M 25/06

[52] U.S. Cl. ..... 123/119 A; 123/117 A; 123/198 R

[58] Field of Search ..... 123/119 A, 117 A, 103 R, 123/198 R

[56] References Cited

U.S. PATENT DOCUMENTS

| | | | |
|---|---|---|---|
| 2,249,446 | 7/1941 | Vanderpoel et al. | 123/117 A |
| 2,659,353 | 11/1953 | Mallory | 123/117 A |
| 3,042,134 | 7/1962 | Majewski | 123/117 A X |
| 3,301,242 | 1/1967 | Candelise | 123/117 A |
| 3,877,452 | 4/1975 | Wohira et al. | 123/119 A |
| 3,888,222 | 6/1975 | Tomita | 123/119 A |
| 3,954,091 | 5/1976 | Stumpp | 123/119 A |
| 4,008,697 | 2/1977 | Kono | 123/119 A X |
| 4,040,402 | 8/1977 | Nohira et al. | 123/119 A |

FOREIGN PATENT DOCUMENTS

| | | |
|---|---|---|
| 2308781 | 2/1973 | Fed. Rep. of Germany . |
| 2449431 | 10/1974 | Fed. Rep. of Germany . |
| 2605864 | 1/1977 | Fed. Rep. of Germany . |
| 1320067 | 6/1973 | United Kingdom . |
| 1323880 | 7/1973 | United Kingdom . |
| 1340660 | 12/1973 | United Kingdom . |
| 1409141 | 10/1975 | United Kingdom . |
| 1410847 | 10/1975 | United Kingdom . |
| 1454433 | 11/1976 | United Kingdom . |

*Primary Examiner*—Wendell E. Burns

*Attorney, Agent, or Firm*—Schwartz, Jeffery, Schwaab, Mack, Blumenthal & Koch

[57] ABSTRACT

A vacuum actuated system comprises a carburetor induction passage having a plurality of vacuum ports, vacuum servo means, fluid network means connecting the plurality of vacuum ports to the vacuum servo means and control means for selectively opening and closing communication between at least one of the plurality of vacuum ports and the vacuum servo means.

10 Claims, 10 Drawing Figures

VACUUM ACTUATED SYSTEM

BACKGROUND OF THE INVENTION

The present invention relates to a vacuum actuated system, such as an exhaust gas recirculation (EGR) control system or a spark timing control system.

It is known to operate a vacuum servo means for an EGR control valve on a single vacuum at a certain vacuum port above the idle speed position of the throttle valve. Operation of the vacuum servo means for the EGR control valve on the single vacuum involves the following problem. If the contour of a valve member of the EGR control valve and the spring constant of a valve spring of the EGR control valve are designed so as to optimize EGR flow rate for operation at acceleration, the EGR flow rate becomes too high during operation in the vicinity of road load (R/L), while if the contour of the valve member and the spring constant of the valve spring are designed so as to optimize EGR flow rate for operation in the vicinity of road load (R/L), the EGR flow rate becomes too little during operation at acceleration. Thus with the known EGR control system it is difficult to precisely control the engine.

SUMMARY OF THE INVENTION

It is an object of the present invention to provide a vacuum actuated system in which the vacuum based on which a vacuum servo means operates is controlled resonsive to operations of the engine so as to provide precise control of a device actuated by the vacuum servo means over various operation ranges of the engine.

It is another object of the present invention to provide a simple vacuum actuated system.

BRIEF DESCRIPTION OF THE DRAWINGS

The present invention will be described hereinafter in connection with the accompanying drawings, in which.

DETAILED DESCRIPTION OF PREFERRED EMBODIMENTS

Figure 4:
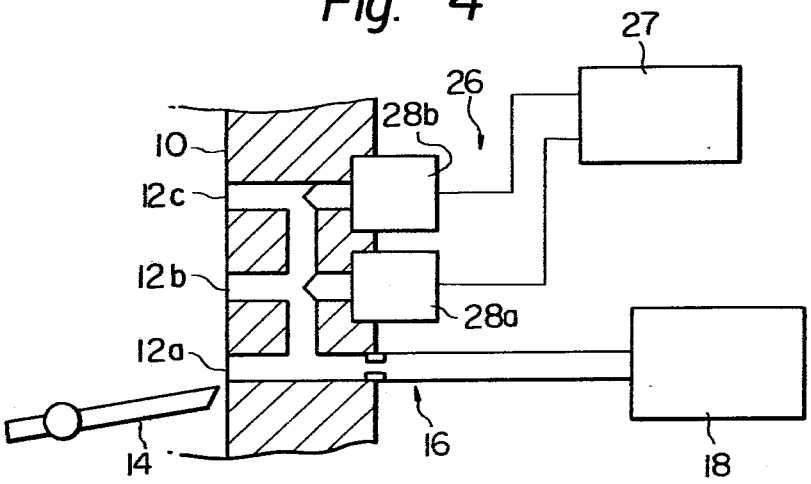
FIG. 4 is a schematic diagram of a first embodiment of a vacuum actuated system according to the present invention.

Referring to the accompanying drawings and particularly to FIG. 4 thereof, there is shown a carburetor induction passage 10 having a plurality of vacuum ports 12*a*, 12*b* and 12*c* opening to the carburetor induction passage 10. These ports 12*a*, 12*b* and 12*c* are disposed in a straight line and above the idle speed position of a throttle flap 14 (illustrated by solid line) such that the port 12*b* is disposed upstream of the port 12*a* and the port 12*c* is disposed upstream of the port 12*b*.

The vacuum ports 12*a*, 12*b* and 12*c* may be arranged in a zigzag line or other arrangements may be employed.

Fluid network means, generally indicated by 16, establishes fluid connection between all of the vacuum ports 12*a*, 12*b* and 12*c* and a vacuum servo means 18 for actuating a device to be vacuum actuated. The vacuum ports 12*b* and 12*c* are closed or opened by control means, generally indicated by 26.

The control means 26 comprises engine operating condition detecting means 27 and two shut-off valves 28*a* and 28*b* which under the control of the engine operating condition detecting means 27 open or close the vacuum ports 12*b* and 12*c*, respectively.

Figure 1:
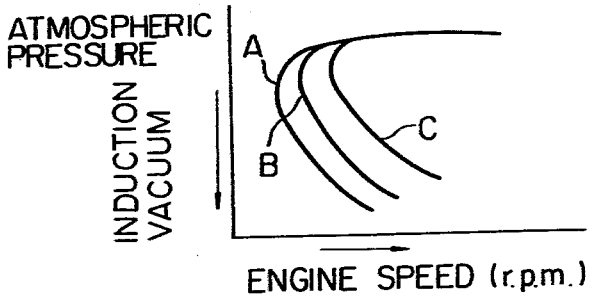
FIG. 1 shows the relationship of vacuum transmitted to a vacuum servo means against engine speed.
Figure 2:
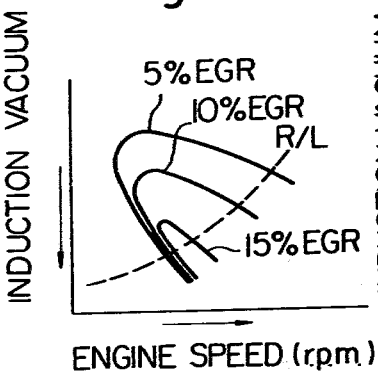
FIG. 2 shows the relationship of induction vacuum against engine speed at different EGR flow rates (%) if the contour of a valve member of an EGR control valve and the spring constant of a valve spring of the EGR control valve are designed so as to optimize EGR flow rate for operation at acceleration.
Figure 3:
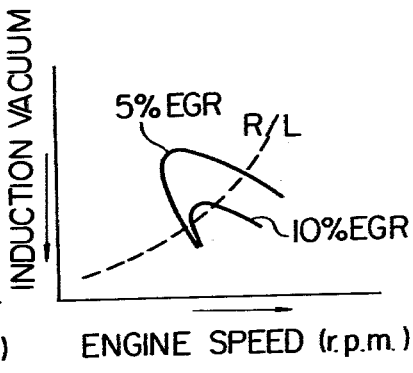
FIG. 3 shows the relationship of induction vacuum against engine speed at different EGR flow rates if the contour of the valve member and the spring constant of the valve spring are designed so as to optimize EGR flow rate for operation in the vicinity of road load (R/L)

Referring to FIG. 1, shown in the graph are characteristic curves of vacuum transmitted to the vacuum servo means 18 if the vacuum ports 12*b* and 12*c* are opened or closed. Curve A represents the change in vacuum at the vacuum servo means 18 if the vacuum port 12*a* alone is open, while the other vacuum ports 12*b* and 12*c* are closed. Curve B represents the change in vacuum at the vacuum servo means 18 if both of the vacuum ports 12*a* and 12*b* are opened, while the other vacuum port 12*c* is closed. Curve C represents the change in vacuum at the vacuum servo means 18 if all of the vacuum ports 12*a*, 12*b* and 12*c* are opened.

If desired, the change in vacuum at the vacuum servo means 18 other than those represented by the above curves A, B and C may be obtained by selecting another vacuum port or ports to be closed.

Referring to the parameters to be employed by the engine operating condition detecting means 27, they differ depending on what kind of vacuum actuated device is used. For example, one or a combination of two or more of transmission speed position, throttle opening degree, accelerator pedal position, engine speed (r.p.m.), vehicle speed, induction vacuum and temperature at various parts of the engine may be employed.

Figure 5:
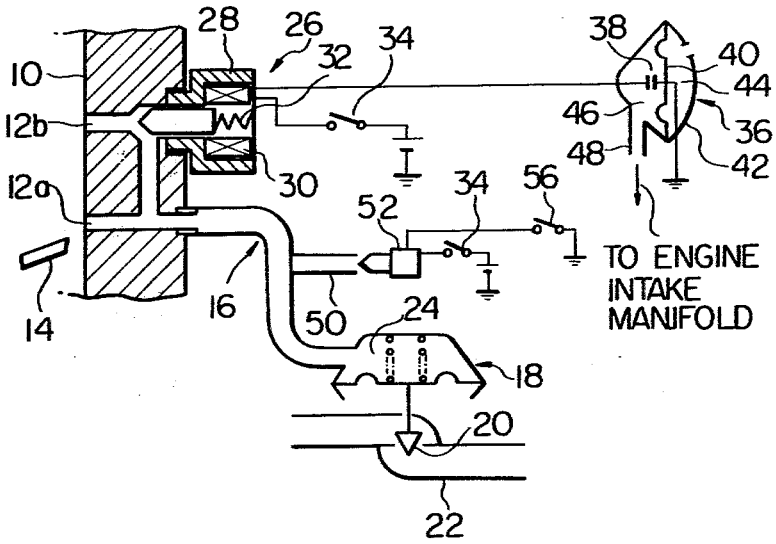
FIG. 5 is a schematic diagram of a second embodiment of a vacuum actuated system according to the present invention.

Referring next to FIG. 5, the same reference numerals used in FIG. 4 are employed to indicate the similar parts or portions. A carburetor induction passage 10 has two vacuum ports 12*a* and 12*b*.

Fluid network means 16 establishes fluid connection of the vacuum ports 12*a* and 12*b* to a vacuum servo means which is in the form of a vacuum-actuated diaphragm device 18. The vacuum-actuated diaghragm device 18 is operatively connected to an EGR control valve 20. The EGR control valve 20 is spring biased toward a closed position in which the valve 20 closes an EGR conduit 22 to shut off flow of the exhaust gases through the EGR conduit 22 and is moved by the vacuum-actuated diaphragm device 18 toward an open position responsive to vacuum level within a vacuum chamber 24 above the diaphragm of the device 18. The vacuum chamber 24 at all times communicates with the vacuum port 12*a* while communication between the vacuum port 12*b* and the vacuum chamber 24 is selectively opened and closed by control means 26.

The control means 26 comprises a solenoid valve 28 which normally closes the vacuum port 12*b* when its solenoid 30 is deenergized. The solenoid 30 is energized when engine induction vacuum (intake manifold vacuum) is higher than a predetermined level of −200 mmHg. The energization of the solenoid 30 will cause the solenoid valve 28 to open the vacuum port 12*b* against the bias of a spring 32 thereby establishing fluid communication between the vacuum port 12*b* and the vacuum chamber 24 of the vacuum-actuated diaphragm 18. The energization of the solenoid 30 is effected when an engine ignition switch 34 and an induction vacuum responsive switch 36 are closed. The switch 36 includes a pair of normally open contacts 38 which are closed by a vacuum-actuated diaphragm 40. The diaphragm 40 divides a casing 42 into a chamber 44 opening to the atmosphere and into a chamber 46 communicating with the engine intake manifold, not shown, through a conduit 48. The diaphragm 40 is preloaded by a spring, not shown, such that the diaphragm 40 closes the pair of contacts 38 when the induction vacuum is higher than −200 mmHg.

During operation of the engine under high load, the production vacuum is lower than −200 mmHg thereby keeping the pair of contacts 38 of the switch 36 opened. Under this condition, the solenoid valve 26 closes the vacuum port 12*b* because the solenoid 30 is deenergized, and thus the vacuum-actuated device 18 responsive to vacuum at the vacuum port 12*a* along actuates the EGR control valve 20.

During operation of the engine under light load, the induction vacuum is higher than −200 mmHg thereby closing the pairs of contacts 38 of the switch 36. Under this condition, the solenoid valve 26 opens the vacuum port 12*b* because the solenoid 30 is energized, and thus the vacuum-actuated diaphragm device 18 actuates the EGR control valve 20 in response to the resultant vacuum of the vacuum at the vacuum port 12*a* and that at the vacuum port 12*b*.

It will now be recognized that opening of the EGR conduit 22 by the EGR control valve 20 is a function of vacuum at the vacuum port 12*a* alone when the engine operates under high load, while the opening is a function of the resultant vacuum of the vacuum at the vacuum port 12*a* and that at the vacuum port 12*b* when the engine operates under light load.

Referring to FIG. 1, a curve A represents the change of vacuum within the vacuum chamber 24 of the vacuum-actuated diaphragm device 18 during operation of the engine under high load, while a curve B represents change of vacuum within the vacuum chamber 24 during operation of the engine under light load. In other words, the change of vacuum at the vacuum port 12*a* alone is represented by the curve A, while the change of resultant vacuum of the vacuum at the vacuum port 12*a* and that at the vacuum port 12*b* is represented by the curve B. The curves A and B demonstrate that opening of the vacuum port 12*b* will reduce the level of vacuum within the vacuum chamber 24 of the vacuum-actuated diaphragm device 18.

Figure 6:
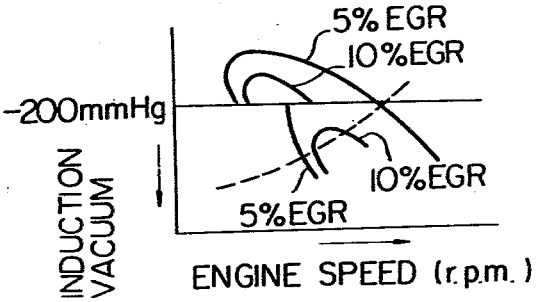
FIG. 6 shows the relationship of induction vacuum against engine speed at different EGR flow rates (%) obtained by the vacuum actuated system shown in FIG. 5.

FIG. 6 shows the relationship of induction vacuum against engine speed at 5% EGR and 10% EGR obtained by the vacuum actuated system shown in FIG. 5.

In order to improve the fuel economy and driveability, there is provided air bleed means for bleeding air into the fluid network means 16 when a transmission, not shown, associated with the engine is shifted into the highest speed position. In this embodiment the transmission has four forward speed positions and the air bleed means bleeds air into the fluid network means 16 when the transmission is shifted into the fourth speed position. The air bleed means includes an air bleed conduit 50 having one end opening to the fluid network means 16 and an opposite end openable to the atmosphere under the control of a solenoid valve 52. The solenoid valve 52, when its solenoid is deenergized, closes the opposite end of the air bleed conduit 50. Energization of the solenoid valve 52 is effected when the engine ignition switch 34 and a transmission shift position responsive switch 56 are closed. The switch 56 is closed when the transmission is shifted into the fourth speed position. When the transmission is shifted into the fourth speed position, the solenoid valve 52 is energized to open the opposite end of the air bleed conduit 50 thereby permitting air to be bled into the fluid network means 16 and in turn into the vacuum chamber 24 of the vacuum-actuated diaphragm device 18. Under this condition the vacuum within the vacuum chamber 24 is reduced to approximately the atmospheric level thereby causing the EGR control valve 20 to close the EGR conduit 22. Thus the EGR rate when the transmission is shifted into the fourth speed position is negligible so that fuel economy and driveability under this condition are improved.

Figure 7:
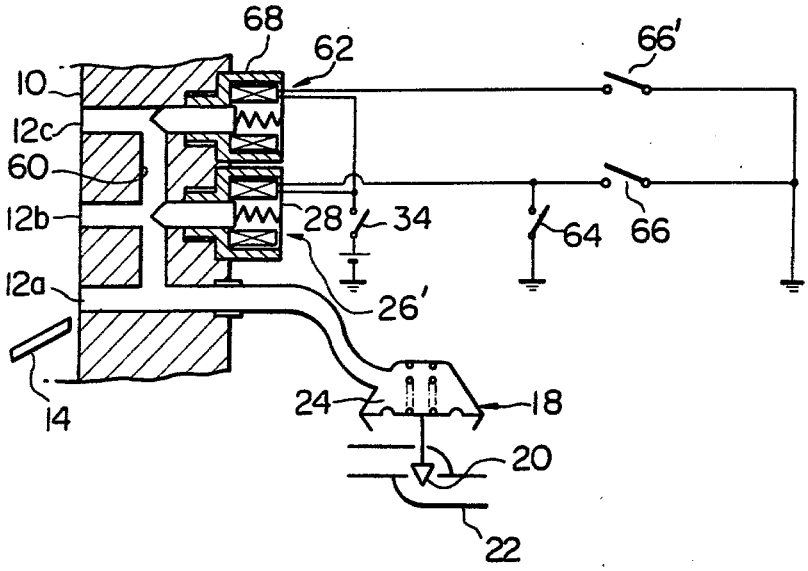
FIG. 7 is a schematic diagram of a third embodiment of a vacuum actuated system according to the present invention.

The third embodiment shown in FIG. 7 is different from the second embodiment in the following respects. In the third embodiment, a carburetor induction passage 10 has a third vacuum port 12*c* in addition to the two vacuum ports 12*a* and 12*b*. The third vacuum port 12*c* opens to the carburetor induction passage 10 at a location upstream of the vacuum port 12*b* and is fluidly connected to a fluid network means 16 by a passage 60. Although, in the second embodiment, the control means 26 that normally closes fluid communication between the vacuum port 12*b* and the vacuum-actuated diaphragm device 18, opens the communication when the engine induction vacuum is higher than −200 mmHg, control means 26′ of the third embodiment opens fluid communication between the vacuum port 12*b* and a vacuum-actuated diaphragm device 18 when a four-speed transmission is shifted into either the first speed position or the second speed position or when the transmission is shifted into the fourth speed position. In the third embodiment, in addition to the first control means 26′ a second control means 62 is provided. The second control means 62 normally closes fluid communication between the third vacuum port 12*c* and the vacuum-actuated diaphragm device 18, but opens the communication when the transmission is shifted into the fourth speed position.

Describing specifically the third embodiment, the control means 26′ includes a solenoid valve 28 which when it is deenergized, closes the vacuum port 12*b*. When it is energized, the solenoid valve 28 opens the vacuum port 12*b* to open communication between the vacuum port 12b and the vacuum-actuated diaphragm device 18. The energization of the solenoid valve 28 is effected upon closing of a switch 64, which is closed when the transmission is shifted into either the first speed position or the second speed position, when the engine ignition switch 34 is closed or upon closing of a switch 66, which is closed when the transmission is shifted into the fourth speed position, when the ignitiin switch 34 is closed.

The control means 62 includes a solenoid valve 68 which when it is deenergized, closes the vacuum port 12c. When it is energized, the solenoid valve 68 opens the vacuum port 12c to open communicating between the vacuum port 12c and the vacuum-actuated diaphragm device 18. The energization of the solenoid valve 68 is effected upon closing of both of the ignition switch 34 and a switch 66' which is relayed with the switch 66 to be closed when the transmission is shifted into the fourth speed position.

Reverting to FIG. 1, a curve C represents the change of resultant vacuum of vacuum at the vacuum port 12a, that at the vacuum port 12b and that at the vacuum port 12c. It will be recognized that the vacuum as represented by the curve C is supplied to the vacuum-actuated diaphragm device 18 when the transmission is shifted into the fourth speed position because under this condition the solenoid valves 28 and 68 open the vacuum ports 12b and 12c.

During operation of the engine with the transmission being shifted into the first speed position or the second speed position, both of the switches 34 and 64 are closed, while the switches 66 and 66' are opened. Under this condition the solenoid valve 28 is energized to open the vacuum port 12b, while the vacuum port 12c is closed by the solenoid valve 68. Thus, the resultant vacuum as represented by the curve B (see FIG. 1) is transmitted to the vacuum chamber 24 of the vacuum-actuated diaphragm device 18 and the EGR control valve 20 is controlled by the device 18 as a function of the resultant vacuum.

During operation of the engine with the transmission being shifted into the third speed position, the switches 64, 66 and 66' are opened. Under this condition, both of the solenoid valves 28 and 68 are closed and the EGR control valve 20 is controlled as a function of the vacuum at the vacuum port 12a alone, as represented by the curve A (see FIG. 1).

During operation of the engine with the transmission being shifted into the fourth speed position, the switches 66 and 66' are closed, while the switch 64 is opened. Under this condition both of the solenoid valves 28 and 68 are energized to open the vacuum ports 12b and 12c. Thus the EGR control valve 20 is controlled by the vacuum-actuated diaphragm device 18 as a function of the resultant vacuum, represented by the curve C (see FIG. 1), of vacuum at all the vacuum ports 12a, 12b and 12c.

It will now be recognized from the preceding description that in the second embodiment the EGR control valve 20 is actuated in three different manners responsive to speed positions of the transmission associated with the engine.

Figure 8:
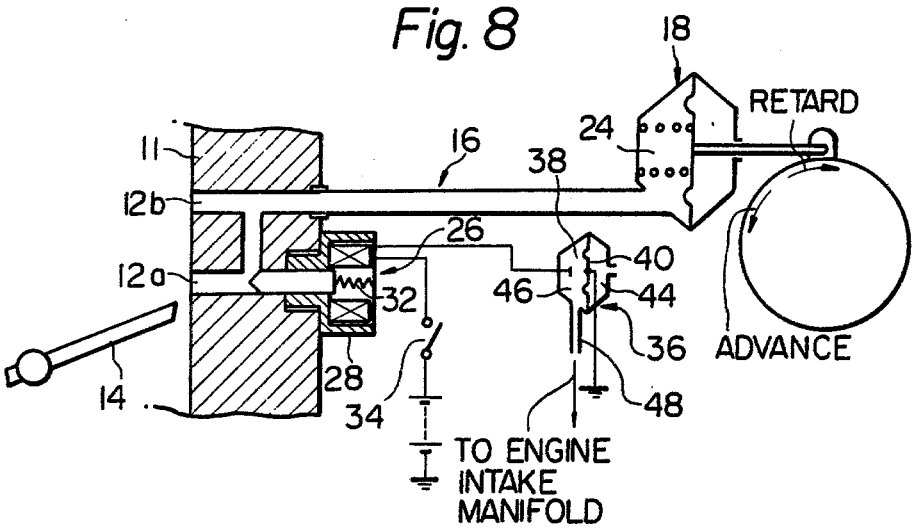
FIG. 8 is a schematic diagram of a fourth embodiment of a vacuum actuated system according to the present invention.

The fourth embodiment shown in FIG. 8 is different from the second embodiment shown in FIG. 5 in that in the fourth embodiment, a vacuum-actuated diaphragm device 18 is operatively connected with a distributor breaker plate 70 and in that control means 26 normally closes a vacuum port 12a, but opens the vacuum port 12a when induction vacuum is higher than a predetermined level of −200 mmHg. The distributor breaker plate 70 is spring biased in a spark timing retarded setting direction, while the vacuum-actuated device 18 responsive to the vacuum within its vacuum chamber 24 moves the distributor breaker plate 70 in an advanced spark timing direction.

The operation of the fourth embodiment is as follows.

During operation of the engine under high load, induction vacuum is lower than −200 mmHg thereby keeping a pair of contacts 38 of a switch 36 opened. Under this condition, a solenoid valve 28 closes the vacuum port 12a because a solenoid 30 is deenergized, and thus the vacuum-actuated device 18 moves the distributor breaker plate 70 toward the advanced spark timing position in response to vacuum at the vacuum port 12b alone.

During operation of the engine under light load, induction vacuum is higher than −200 mmHg thereby closing the pair of contacts 38 of the switch 36. Under this condition, the solenoid valve 28 is energized to open communication between the vacuum port 12a and the vacuum-actuated diaphragm device 18 and thus the diaphragm device 18 moves the distributor plate 70 in advanced spark timing direction in response to the resultant vacuum of the combined vacuum at the vacuum port 12b and that at the vacuum port 12a. Because the resultant vacuum of the combined vacuum at the vacuum port 12a and that at the vacuum port 12b is higher than the vacuum at the vacuum port 12b alone, the spark advances farther during light load engine operation than the spark timing during high load engine operation.

Figure 9:
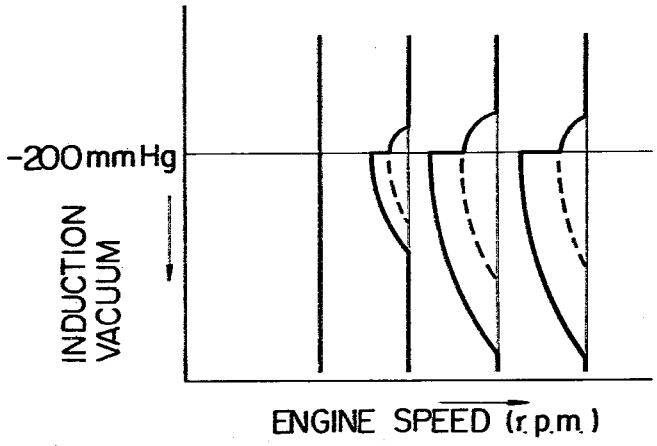
FIG. 9 shows vacuum advance characteristics obtained by the vacuum actuated system shown in FIG. 8.

FIG. 9 shows vacuum advance characteristic curves obtained by the vacuum actuated system shown in FIG. 8. It will be noted that the same degree of vacuum advance is provided at relatively low engine speed (r.p.m.) when the induction vacuum is higher than −200 mmHg.

In the fourth embodiment shown in FIG. 8, the predetermined vacuum level is −200 mmHg, but the predetermined vacuum level may range from −100 mmHg to −300 mmHg depending on the specifications of the engine and the weight of the vehicle driven by the engine.

Figure 10:
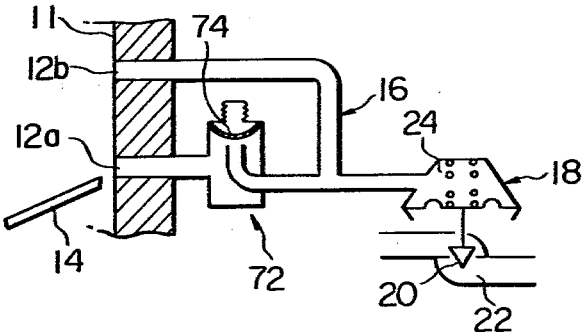
FIG. 10 is a schematic diagram of a fifth embodiment of a vacuum actuated system according to the present invention.

The fifth embodiment shown in FIG. 10 is different from the second embodiment shown in FIG. 5 in that instead of the control means 26 shown in FIG. 5, a control means 72 selectively closes and opens fluid communication between a vacuum port 12a and a vacuum-actuated diaphragm device 18. The control means 72 takes the form of a thermo-sensing valve including a bimetal 74 as a valve member. The thermo-sensing valve 72 is constructed and arranged such that when the engine coolant temperature is lower than a predetermined value, the bimetal 74 closes communication between the vacuum port 12b and the diaphragm device 18.

It will be recognized that since vacuum within the vacuum chamber 24 of the diaphragm device is lower when the communication between the vacuum port 12a and the diaphragm device 18 is closed rather than that when the communication is opened, opening the degree of an EGR control valve 18 is reduced when the communication between the vacuum port 12a and the diaphragm device 18 is closed, that is, when the engine coolant temperature is lower than the predetermined value.

What is claimed is:

1. A vacuum actuated system comprising:

a carburetor induction passage including a throttle valve;

a first vacuum port and a second vacuum port, both being disposed above the idle speed position of said throttle valve, said first and second vacuum ports opening to said carburetor induction passage;

a vacuum servo means;

fluid network means connecting said first and second vacuum ports to said servo means;

control means for selectively opening and closing communication between said second vacuum port and said servo means;

an exhaust gas recirculation control valve spring biased toward a closed position, in which said vacuum servo means moves said exhaust gas recirculation control valve toward an open position in response to vacuum applied thereto, said second vacuum port being disposed upstream of said first vacuum port, and said control means including a solenoid valve means normally closing said second vacuum part, said solenoid valve being operative to open said second vacuum port when the engine induction vacuum is higher than a predetermined level.

2. A vacuum actuated system as claimed in claim 1, including air bleed means for bleeding air into said fluid network means when a transmission associated with the engine is shifted into a predetermined speed position.

3. In an internal combustion engine for an automobile, the internal combustion engine including an exhaust gas recirculation passageway, an exhaust gas recirculation control valve in the exhaust gas recirculation passageway to control flow of exhaust gases passing therethrough, means for biasing the exhaust gas recirculation control valve toward a closed position and vacuum servo means for urging, against the biasing means, the exhaust gas recirculation control valve toward an open position, the improvement which comprises:

a body having an induction passage therein for feeding air to said engine;

a throttle valve disposed in said induction passage to divide the same into a vacuum side downstream of said throttle valve and an atmospheric side upstream of said throttle valve, said throttle valve being angularly movable between a closed position and an open position;

means for defining an enclosed common space having a first passage and at least one second passage leading from said enclosed common space to said induction passage, said first and second passages opening, via respective ports, into said induction passage on said atmospheric side of said throttle valve, said ports being spaced, at different distances, from the level defined by said throttle valve in said closed position thereof;

means for establishing constant fluid communication between said enclosed common space and said vacuum servo means;

valve means for closing said second passage to cut off fluid communication between the corresponding port and said enclosed common space; and means for opening said valve means in response to a predetermined operating condition of said engine.

4. An internal combustion engine as claimed in claim 3, wherein said enclosed common space and said first and second passages are formed within said body.

5. An internal combustion engine as claimed in claim 3, wherein the port of said second passage is disposed upstream of the port of said first passage, said valve means includes a valve closing said second passage, and said opening means includes a solenoid means for opening said valve closing said second passage and circuit means for energizing said solenoid means when induction vacuum of said engine is higher than a predetermined level.

6. An internal combustion engine as claimed in claim 5, further comprising an air bleed port in communication with said enclosed common space;

an air bleed valve means for closing said air bleed port; and means for opening said air bleed valve means in response to a predetermined gear position of a transmission associated with said engine.

7. An internal combustion engine as claimed in claim 3, further comprising another second passage leading from said enclosed common space to said induction passage to open thereinto via respective ports on said atmospheric side of said throttle valve which are spaced, at different distances from the level defined by said throttle valve in said closed position thereof and which are disposed upstream of the port of said first passage, wherein said valve means includes a first valve closing one of said two second passages and a second valve closing the other of said second passages, and wherein said opening means includes a first solenoid means for opening said first valve when energized, a second solenoid means for opening said second valve when energized, and circuit means for energizing said first and second solenoid means in response to gear positions of a transmission associated with said engine.

8. An internal combustion engine as claimed in claim 3, wherein the port of said second passage is disposed downstream of the port of said first passage, wherein said valve means includes a valve closing said second passage, and wherein said opening means includes a thermosensing means for opening said valve when coolant temperature of said engine is higher than a predetermined level.

9. In an internal combustion engine for an automobile, the internal combustion engine including vacuum servo means, the improvement which comprises:

a body having an induction passage therein for feeding air to said engine;

a throttle valve disposed in said induction passage to divide the same into a vacuum side downstream of said throttle valve and an atmosphere side upstream of said throttle valve, said throttle valve being angularly movable between a closed position and an open position;

said body having an enclosed common space having a first passage and a second passage extending through said body from said enclosed space to said induction passage, said first and second passages opening, via respective ports, into said induction passage on said atmospheric side of said throttle valve, said ports being spaced, at different distances, from the level defined by said throttle valve in said closed position thereof;

means for establishing constant fluid communication between said enclosed common space and said vacuum servo means;

valve means for closing said second passage to cut off fluid communication between the corresponding port and said enclosed common space; and means for opening said valve means when induction vacuum of said engine is higher than a predetermined level.

10. In an internal combustion engine for an automobile, the internal combustion engine including a distributor breaker plate spring biased in a spark retarded setting position and vacuum servo means for moving the distributor breaker plate in an advanced spark timing direction in response to vacuum applied thereto, the improvement which comprises:

a body having an induction passage therein for feeding air to said engine;

a throttle valve disposed in said induction passage to divide the same into a vacuum side downstream of said throttle valve and an atmospheric side upstream of said throttle valve, said throttle valve being angularly movable between a closed position and an open position;

said body having an enclosed common space having a first passage and a second passage extending through said body from said enclosed common space to said induction passage, said first and second passages opening, via respective ports, into said induction passage on said atmospheric side of said throttle valve, said ports being spaced, at different distances, from the level defined by said throttle valve in said closed position thereof, the port of said first passage being disposed upstream of the port of said second passage;

means for establishing constant fluid communication between said enclosed common space and said vacuum servo means;

a valve closing said second passage to cut off fluid communication between the port of said second passage and said enclosed common space;

a solenoid means for opening said valve when energized; and circuit means for energizing said solenoid means when induction vacuum of said engine is higher than a predetermined level.

* * * * *